US005823889A

United States Patent [19]

Aoyama

[11] Patent Number: 5,823,889

[45] Date of Patent: Oct. 20, 1998

[54] SOLID GOLF BALL AND METHOD OF MAKING

[75] Inventor: Steven Aoyama, Marion, Mass.

[73] Assignee: Acushnet Company, Fairhaven, Mass.

[21] Appl. No.: 905,069

[22] Filed: Aug. 1, 1997

Related U.S. Application Data

[63] Continuation-in-part of Ser. No. 482,518, Jun. 7, 1995, Pat. No. 5,688,192.

[51] Int. Cl.[6] ..... A63B 37/06

[52] U.S. Cl. ..... 473/374; 473/369; 473/370; 473/377

[58] Field of Search ..... 473/367, 368, 473/369, 370, 374, 376, 377

[56] References Cited

U.S. PATENT DOCUMENTS

| | | |
|---|---|---|
| 719,500 | 2/1903 | Painter . |
| 3,238,156 | 3/1966 | Kohrn . |
| 3,239,228 | 3/1966 | Crompton . |
| 3,940,145 | 2/1976 | Gentiluomo . |
| 4,026,561 | 5/1977 | Baldorossi et al. . |
| 4,085,937 | 4/1978 | Schenk . |
| 4,274,637 | 6/1981 | Molitor . |
| 4,431,193 | 2/1984 | Nesbitt . |
| 4,650,193 | 3/1987 | Molitor et al. . |
| 4,674,170 | 6/1987 | Hubbert et al. . |
| 4,674,751 | 6/1987 | Molitor et al. . |
| 4,805,914 | 2/1989 | Toland . |
| 4,836,552 | 6/1989 | Puckett et al. . |
| 4,839,116 | 6/1989 | Puckett et al. . |
| 4,848,770 | 7/1989 | Shama . |
| 4,863,167 | 9/1989 | Matsuki et al. . |
| 5,150,906 | 9/1992 | Molitor et al. . |
| 5,482,285 | 1/1996 | Yabuki et al. . |
| 5,688,192 | 11/1997 | Aoyama ..... 473/374 |

*Primary Examiner*—George J. Marlo
*Attorney, Agent, or Firm*—Pennie & Edmonds LLP

[57] ABSTRACT

A finished, regulation long range, solid construction, multi-piece golf ball including a discrete cover and a core. The core has an inner and an outer portion. Either the outer portion or the entire core has a plurality of gas containing compressible cells dispersed therein, and either the outer portion or the entire core the a specific gravity greater than 1.

The compressible cells are produce by a method selected from the group consisting of foaming, using a blowing agent, injecting a gas and incorporating a plurality of microspheres having a flexible outer surface.

20 Claims, 2 Drawing Sheets

SOLID GOLF BALL AND METHOD OF MAKING

This application is a continuation-in-part of application Ser. No. 08/482,518, filed Jun. 7, 1995, now U.S. Pat. No. 5,688,192, which is incorporated herein by reference.

BACKGROUND OF THE INVENTION

Present day golf balls can be classified under one of two categories: solid balls and wound balls. The first category of solid balls includes unitary or one-piece golf balls as well as multi-piece balls. One-piece golf balls, seldom used as playing balls, are typically made from a solid piece of polybutadiene rubber, with dimples molded into its surface. Although inexpensive and durable, these unitary balls are generally limited to use as practice balls because they do not give the desired distance when hit. In contrast, multi-piece solid balls usually consist of a core of hard, polymeric materials enclosed in a distinct, cut-proof cover made of DuPont's SURLYN, an ionomer resin. Because of its durability and low spin, which produces greater distance and reduced hooking and slicing, this type of ball is the most popular among ordinary players.

Wound golf balls are manufactured by wrapping elastic windings under high tension around a solid rubber or liquid filled center. A cover, usually SURLYN or balata is molded over the windings to form the ball. This winding process naturally incorporates a certain amount of trapped air within the layer of windings. The air trapped within a wound construction ball provides certain characteristics which are considered by many golfers to be desirable. It creates a soft "feel" at impact due to its compressible nature and high resiliency due to its high efficiency (low damping) as a spring. For skilled golfers, these wound balls typically provide a higher spin rate and offer more control over the ball's flight than solid balls.

Unfortunately, wound construction golf balls are also more difficult and expensive to manufacture than solid construction golf balls. Also, wound golf balls have comparatively shorter shelf life and lower resistance to certain types of damage than solid balls.

Various attempts have been made to mimic the advantages of wound construction balls using solid construction manufacturing techniques. However, these balls generally have used softer core materials, softer cover materials, layers of soft materials combined with conventional materials or combinations thereof. Examples of such balls include the Titleist HP2, Pinnacle Performance, Ultra Competition, Ultra Tour Balata, Maxfli HT Hi Spin, Precept EV Extra Spin, Altus Newing, Top-Flite Tour Z-Balata, Top-Flite Tour and Kasco's "Dual Core" balls. Likewise U.S. Pat. No. 4,650,193 to Molitor also discloses a golf ball made from relatively "soft" materials. While these solid construction golf balls sometimes produce improved feel or playing characteristics which simulate those of wound balls, they fail to completely capture the same desired characteristics. In addition, the soft materials often produce inadequate resilience or durability or both.

This invention takes a different approach. Instead of using soft but incompressible materials, it employs compressible materials such as gases and flexible shell microspheres in the core of a solid construction golf ball. This approach provides a much better simulation of the effects of the trapped air in a wound construction golf ball while using a manufacturing process similar to that for solid golf balls. The result is a ball having the soft feel and high resilience of wound construction balls combined with the manufacturing simplicity, shelf life and durability of solid construction balls.

Although prior art golf balls have employed a gaseous component, these balls have been typically special purpose balls or balls where only the covers incorporate such a material. See e.g., in U.S. Pat. No. 5,150,906 and U.S. Pat. No. 4,274,637 to Molitor et al. and U.S. Pat. No. 4,431,193 to Nesbitt. Representative of special purpose balls are short-distance balls such as those disclosed in U.S. Pat. No. 4,836,552 to Puckett et al., floater balls such as those described in U.S. Pat. No. 4,085,937 to Schenk and "Nerf"-type toy and practice balls. These balls incorporate gas in the ball materials for the purposes of reducing the ball's weight and/or its potential for causing damage to a struck object. They do not feel or perform in any way like a normal wound or solid construction golf ball.

Furthermore, although certain prior art balls have included gas containing cells in the form of glass microspheres, such cells do not impart compressibility to the ball since the glass walls of the microspheres are rigid. Examples of such balls involving rigid glass microspheres are illustrated in U.S. Pat. No. 5,482,285 to Yabuki et al., which discloses the inclusion of glass microspheres to reduce the specific gravity of the ball's outer core to a range of from 0.2 to 1. Similarly U.S. Pat. No. 4,839,116 to Puckett et al. also discloses the inclusion of incompressible glass microspheres as fillers.

SUMMARY OF THE INVENTION

This invention relates to multi-piece golf balls and their method of manufacture. In particular, this invention is directed towards finished, regulation long range, solid construction, multi-piece golf balls comprising a core of a material incorporating a compressible gaseous material or cellular material in the core, and a spherical cover or shell of polymeric material. The core comprises an inner and an outer portion. In another embodiment, the core comprises inner and outer layers. The compressible material e.g., plurality of gas containing compressible cells may be dispersed or distributed in a limited part of the core such as an outer portion or an inner portion so that the portion containing the compressible material has a specific gravity of greater than 1. Preferably, the specific gravity is about 1.05 to 1.15. Also the compressible cells may be distributed throughout the entire core.

In one embodiment, the cells comprise a plurality of microspheres having flexible outer shells. The shells may be made of polymer, such as an acrylonitrile copolymer. The diameter of the cells are preferably about less than or equal to 10% of the diameter of the core. It is also preferable that the cells comprise about 5 to 50% by volume of the entire core and more preferably 10 to 15%. When the core comprises inner and outer layers, it is preferred that the outer layer of the core has a thickness of 0.05 to 0.80 inches and more preferably that the outer layer thickness ranges from 0.10 to 0.25 inches.

Furthermore, this invention provides a method for making a finished regulation long range, solid construction, multi-piece golf ball, comprising a discrete cover and a core, wherein the core comprising an inner and an outer portion, said outer portion having a plurality of gas containing compressible cells dispersed therein and said outer portion having a specific gravity greater than 1. The method comprises producing the cells by a method selected from the group consisting of foaming, using a blowing agent, injecting a gas and incorporating a plurality of microspheres having a flexible outer surface. Also, the invention relates to a method of making a golf ball wherein the core has a plurality of gas containing compressible cells dispersed throughout the entire core and said core having a specific gravity greater than 1.

This invention is further directed to a solid construction golf ball having the beneficial characteristics of both wound and solid construction type balls. Golf balls produced according to this invention combine the feel and playing characteristics of a wound construction with the shelf life and durability of a solid construction golf ball.

Furthermore, the golf balls of this invention will have advantages over both conventional solid as well as wound construction balls in cold weather. Under such conditions, prior art solid construction balls develop a very hard feel due to the stiffening of the materials. They do, however, retain most of their resilience so they do not lose much distance. On the other hand, prior wound construction balls retain much of their soft feel (because the entrapped air does not stiffen significantly), but they lose distance due to a loss of resilience in the high tension windings. A ball made according to this invention will retain softness like a wound ball, and retain resilience like a solid construction ball.

Another object of this invention is to provide a golf ball having the desired characteristics of a wound construction ball and the manufacturing simplicity and cost-savings of a solid construction ball.

This invention is further directed towards the manufacture of a solid construction golf ball possessing the performance characteristics of a wound ball and benefits of solid construction balls.

A DETAILED DESCRIPTION OF THE PREFERRED EMBODIMENTS

The key to this invention is that compressible materials are incorporated into the construction of the golf ball. "Compressible materials" as used herein are materials whose density is strongly affected by pressure or temperature. Gases would generally be considered to be compressible materials while liquids and solids would not be.

As defined in this invention the word "core" refers to unitary cores as well as multi-layered cores. The compressible materials of this invention can be incorporated into the entire core or into at least one portion or layer of the core. Preferably the compressible gaseous material is incorporated into an outer portion or layer of a core so that the golf ball behaves and plays more like a wound ball. The thickness of the layer in a multi-layered ball containing the compressible material preferably ranges from about 0.05 inches to 0.80 inches, which is generally the diameter of the entire core. More preferably, the thickness of such layer ranges from about 0.10 to 0.25 inches.

Figure 1:
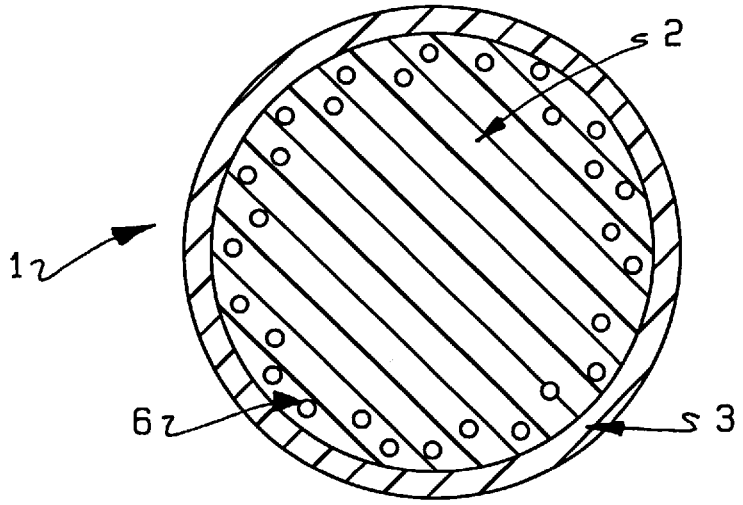
FIG. 1 is a cross-sectional view of a golf ball of this invention where the outer portion of a solid core incorporates a compressible material.
Figure 2:
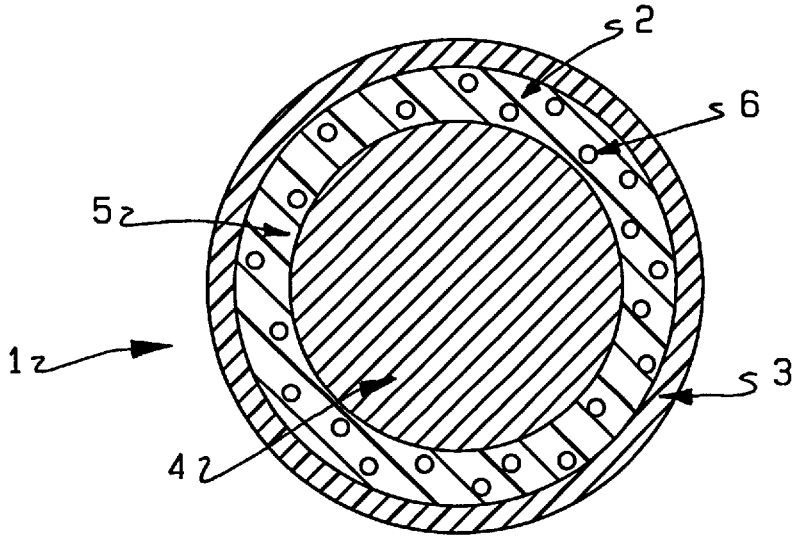
FIG. 2 is a cross-sectional view of a golf ball of this invention where compressible materials are incorporated in the outer layer of the core.
Figure 3:
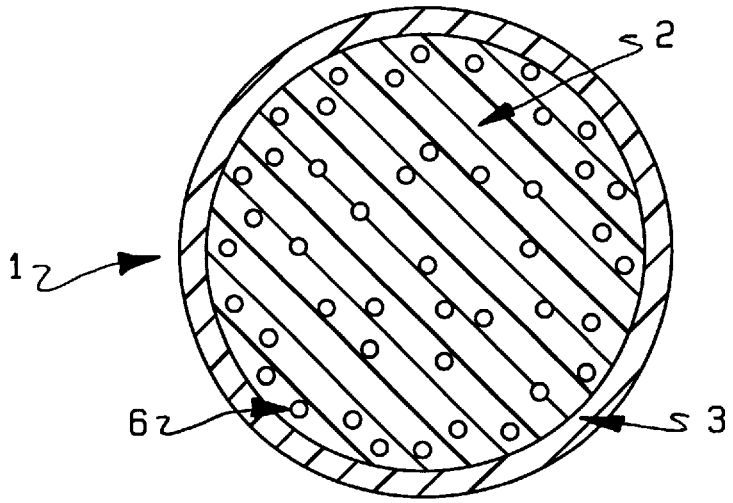
FIG. 3 is a cross-sectioned view of a golf ball of this invention where the entire solid core incorporates a compressible material.

The figures exemplify three embodiments of this invention. These figures are provided to further the understanding of this invention and are not to be construed as limiting the claims in any manner. FIG. 1 illustrates a golf ball 1 with a unitary core 2 which includes the compressible material 6 in the outer portion of the core 2. To complete the ball, a cover 3 is molded over the core 2. In FIG. 2, the ball 1 comprises a multi-layered core 2 comprising an inner core layer 4 and an outer core layer 5. The compressible material 6 is incorporated into the outer core layer 5. In FIG. 3, the ball comprises a unitary core 2 in which the compressible material 6 is incorporated throughout the entire core. Alternatively, the core in this embodiment may be multi-pieced.

Suitable core materials into which the compressible gaseous material can be incorporated include solids, liquid and semi-liquid such as pastes. In general, the core material will essentially be incompressible. Among the materials useful for forming such cores is polybutadiene, a polymer which is presently used to make cores for nearly all commercial golf balls. Also, various thermoplastic materials such as DuPont's SURLYN, an ionomer resin, DuPont's Hytrel, or B.F. Goodrich's Estane, or blends thereof, could be used. Furthermore, materials which are not normally resilient enough for use in golf ball cores may be satisfactory when the compressible gaseous material is incorporated into it may be used. One such example is polyurethane.

The proportions of compressible gaseous material to core material that are suitable will depend upon the core materials used as well as the performance characteristic or effects that are desired of the golf ball. Preferably, the compressible material is distributed uniformly.

In general, a range of about 5% to 50% compressible material by volume of the core, core layer or core portion containing the compressible material is suitable. For outer core portions or layers which have thicknesses equivalent to that of the winding layer in wound balls, 10–15% compressible material by volume of the outer core layer is preferred. However, for thinner portions/layers or portions/layers made of stiffer materials, a higher proportion of compressible material to core material up to about 50% is preferred.

However, to best simulate wound construction golf balls, the amount of compressible material incorporated should be such that the specific gravity of the layer or portion of the core containing the compressible material is greater than 1. Preferably, the specific gravity is 1.05 if the core material is polybutadiene. Also, when the compressible material is placed in an outer core layer or portion, a specific gravity of greater than 1 of such layer or portion keeps the spin rate down, which is often desirable. Incorporation of a quantity of compressible material, which lowers the specific gravity of such layer or portion below 1, is not desired. Since the use of the compressible materials is intended to simulate the amount of air typically trapped in the windings of a wound construction ball, it is desired that the amounts of compressible materials used be similar to the amounts of trapped air. However, in order to obtain specific gravities below 1, for the portion or layer of the core containing the compressible materials, quantities of such materials which exceed the amounts of trapped air in wound balls would be required.

The compressible materials can be incorporated into the core polymer in a number of ways. The core polymeric materials can be "foamed" by various techniques which include, but are not limited to the use of blowing agents, gas injection, mechanical aeration and two-component reactive systems. U.S. Pat. No. 4,274,637 to Molitor describes the use of blowing agents and gas injection to foam polymeric materials. Blowing agents foam the core polymeric materials by decomposing to form gases which are absorbed by these materials. The gas then expands to form the foamed core materials, i.e. cellular core material. Foaming by gas injection can be achieved by injecting a gas under pressure such as nitrogen, air, carbon dioxide, etc. into the material. When the gas expands, the material is foamed.

Alternatively, the gas can be added to the core material by the inclusion of gases encapsulated in microspheres. This addition can be done by mixing gas-filled microspheres into the polymer composition. However, the encapsulating envelope of such gas must be of a material flexible enough to permit compression of the gas inside during impact of the ball by a golf club. Such encapsulating materials include polymeric microspheres, such as acrylonitrile copolymer microspheres, as well as expandable microspheres. However, glass microspheres would not be appropriate for this invention because of their rigidity.

Regardless of the materials from which they are made, appropriate microspheres must be of a size such that they be small enough to act like a continuous medium when incorporated into the core material. Typically a microsphere diameter on the order of at most 10% of the thickness of the core layer or portion incorporating the compressible material is suitable.

Moreover, various crosslinkers and fillers are typically added to the core materials along with the gaseous material in a manner well known in the art. Suitable cross-linking agents include metallic salts of an unsaturated carboxylic acid. These salts are generally zinc diacrylate or zinc dimethacrylate. Of these two cross-linkers, zinc diacrylate has been found to produce golf balls with greater initial velocity than zinc dimethacrylate.

Suitable fillers that can be used in this invention include free radical initiators used to promote crosslinking of the salt and the polybutadiene. The free radical initiator is suitably a peroxide compound such as dicumyl peroxide, 1,1-di (T-butylperoxy) 3,3,5-trimethyl cyclohexane, a-a bis (T-butylperoxy) diisopropylbenzene, 2,5-dimethyl-2,5 di (T-butylperoxy) hexane, or di-T-butyl peroxide, and mixtures thereof. Also other substantially inert fillers such as zinc oxide, barium sulfate and limestone as well as additives can be added to the mixture. The maximum amount of fillers utilized in a composition is governed by the specific gravity of the fillers as well as the maximum weight requirement established by the U.S.G.A. Appropriate fillers generally used range in specific gravity from 2.0–5.6.

There are generally two basic techniques used in the manufacture of golf balls: Compression molding and injection molding. Both these techniques are well-known in the art. To form a ball of the present invention having the compressible material dispersed throughout the core or in a portion of the core, the compressible material is incorporated by adding the microspheres or by some other foaming technique into polybutadiene or some other suitable core material. After the addition of the compressible materials, the core material composition may then be extruded into preforms suitable for molding. The preforms may then be compression molded into spherical cores. The cover, typically of a thermoplastic material, is then either injection molded directly around the core or compression molded using pre-formed hemispheres of cover material placed around the core. Such cover materials, such as SURLYN or balata rubber, are known in the art.

For a ball of the invention where the compressible material is incorporated into a discrete outer layer of the core, the center of the core would be formed by compression molding a core material to form a sphere with a diameter less than that of the finished core. The outer layer of the core which incorporates the compressible material is then either injection molded or compression molded around the center of the core. Finally, the cover would be injection molded or compression molded around the core by conventional means.

While it is apparent that the invention disclosed herein is well calculated to fulfill the objects stated above, it will be appreciated that numerous modifications and embodiments may be devised by those skilled in the art. Therefore, it is intended that the appended claims cover all such modifications and embodiments as falling within the true spirit and scope of the present invention.

I claim:

1. A finished, regulation long range, solid construction, multi-piece golf ball comprising a discrete cover and a core, said core comprising an inner and an outer portion, said outer portion having a plurality of gas containing compressible cells dispersed therein and said outer portion having a specific gravity greater than 1.

2. The golf ball of claim 1 wherein the specific gravity is 1.05 to 1.15.

3. The golf ball of claim 1 wherein the compressible cells are dispersed throughout the entire core and wherein the entire core has a specific gravity of greater than 1.

4. The golf ball of claim 3 wherein said cells comprise a plurality of microspheres having a flexible outer surface.

5. The golf ball of claim 4 wherein said surface is formed from a polymer.

6. The golf ball of claim 5 wherein said polymer is an acrylonitrile copolymer.

7. The golf ball of claim 4 wherein each said microsphere has a diameter of about ≦10% of the diameter of the entire core.

8. The golf ball of claim 1 wherein said cells comprise about 5% to 50% by volume of the entire core.

9. The golf ball of claim 8 wherein said cells comprise about 10% to 15% by volume of the entire core.

10. A finished regulation long range, solid construction, multi-piece golf ball comprising a discrete cover and layered core, said core comprising an outer layer and one or more inner layers, said outer layer having a plurality of gas containing compressible cells dispersed therein and said outer layer having a specific gravity greater than 1.

11. The golf ball of claim 10 wherein the specific gravity is 1.05 to 1.15.

12. The golf ball of claim 10 wherein the compressible material is dispersed within an outer layer of the core which has a thickness of 0.05–0.80 inches.

13. The golf ball of claim 12 wherein the compressible material is dispersed within an outer layer of the core which has a thickness of 0.10–0.25 inches.

14. The golf ball of claim 10 wherein the compressible cells are dispersed throughout the entire core and wherein the entire core has a specific gravity of greater than 1.

15. The golf ball of claim 14 wherein said cells comprise a plurality of microspheres having a flexible outer surface.

16. The golf ball of claim 15 wherein said surface is formed from a polymer.

17. The golf ball of claim 16 wherein said polymer is an acrylonitrile copolymer.

18. The golf ball of claim 15 wherein each said microsphere has a diameter of about ≦10% of the diameter of the entire core.

19. A method of making a finished regulation long range, solid construction, multi-piece golf ball comprising a discrete cover and a core, said core comprising an inner and an outer portion, said outer portion having a plurality of gas containing compressible cells dispersed therein and said outer portion having a specific gravity greater than 1; said method comprising producing said cells by a method selected from the group consisting of foaming, using a blowing agent, injecting a gas and incorporating a plurality of microspheres having a flexible outer surface.

20. A method of making a finished regulation long range, solid construction, multi-piece golf ball comprising a discrete cover and a core, said core having a plurality of gas containing compressible cells dispersed throughout the entire core and said core having a specific gravity greater than 1; said method comprising producing said cells by a method selected from the group consisting of foaming, using a blowing agent, injecting a gas and incorporating a plurality of microspheres having a flexible outer surface.

* * * * *